US007510128B2

(12) United States Patent
Schouten

(10) Patent No.: US 7,510,128 B2
(45) Date of Patent: Mar. 31, 2009

(54) SPRAY NOZZLE FOR CLEANING IMPLEMENTS

(75) Inventor: Pieter Schouten, Berkley, CA (US)

(73) Assignee: Carrand Companies, Inc., Compton, CA (US)

( * ) Notice: Subject to any disclaimer, the term of this patent is extended or adjusted under 35 U.S.C. 154(b) by 381 days.

(21) Appl. No.: 11/260,547

(22) Filed: Oct. 27, 2005

(65) Prior Publication Data

US 2007/0170285 A1 Jul. 26, 2007

Related U.S. Application Data

(60) Provisional application No. 60/622,398, filed on Oct. 27, 2004.

(51) Int. Cl.

| | |
|---|---|
| ***B05B 1/32*** | (2006.01) |
| ***B05B 9/08*** | (2006.01) |
| ***B05B 15/06*** | (2006.01) |
| ***B05B 1/30*** | (2006.01) |

(52) U.S. Cl. ..... 239/541; 239/530; 239/532; 239/569; 239/583

(58) Field of Classification Search ..... 239/154, 239/525, 530, 532, 541, 569, 583; 137/384.2, 137/384.6, 384.8

See application file for complete search history.

(56) References Cited

U.S. PATENT DOCUMENTS

| | | | | |
|---|---|---|---|---|
| 3,940,072 | A * | 2/1976 | Ishikawa et al. | 239/525 |
| 4,260,130 | A * | 4/1981 | Brehm | 251/113 |
| 5,082,185 | A * | 1/1992 | Evans | 239/416.5 |
| 5,678,768 | A * | 10/1997 | Gager et al. | 239/530 |
| 6,520,427 | B1 * | 2/2003 | Chen | 239/526 |
| 6,568,605 | B1 * | 5/2003 | Chen | 239/525 |
| 6,921,032 | B2 * | 7/2005 | Habermacher et al. | 239/525 |

* cited by examiner

*Primary Examiner*—Len Tran
*Assistant Examiner*—Ryan Reis
(74) *Attorney, Agent, or Firm*—George R. McGuire; David L. Nocilly; Bond Schoenenck & King PLLC

(57) ABSTRACT

The present invention provides a detachable nozzle used for interconnecting a hose to a cleaning implement or for use as spray nozzle for a hose. The detachable nozzle extends along a longitudinal axis and includes a downstream end with an internally threaded neck adapted for connection to a hose and an upstream end with an externally threaded neck that is adapted for connection to a cleaning implement or from which water may be discharged. A spring biased actuating trigger engages a lever tied to a spring biased valve and is pivotally movable between its neutral position that places the valve in its closed position, to a fully closed position that places the valve in its fully open position.

6 Claims, 5 Drawing Sheets

SPRAY NOZZLE FOR CLEANING IMPLEMENTS

CROSS-REFERENCE TO RELATED APPLICATION

The present application claims priority to U.S. Provisional Application Ser. No. 60/622,398 filed Oct. 27, 2004.

BACKGROUND OF THE INVENTION

The present invention relates generally to spray nozzles, and more particularly to spray nozzles adapted for interconnecting a hose to a cleaning implement.

Spray nozzles are used to create more focused jets of water being discharged from a hose. Such focused sprays are useful when using the hose as a cleaning aid, such as when it is used to wash the car. The water discharged through a nozzle is generally released at a higher velocity and in a tighter stream than water flowing freely from a hose.

The sprays released from nozzles can typically be predictably varied through controlled use of a trigger associated with the nozzle that moves the nozzle head into varying distances relative to a sealing gasket. However, maintaining the trigger in a particular position generally requires the threading of a set screw that engages and fixes the trigger in a particular position. The set screw, while effective, is difficult to manipulate, and when the nozzle is made from a metal subject to rusting, rust inhibits the movement of the screw.

In addition, prior art nozzles are not typically usable in conjunction with a separate cleaning implement, such as a brush. Instead only one end of the nozzle in adapted for connection to a hose, while the other end is not adapted for interconnection to any external device.

It is therefore a principal object and advantage of the present invention to provide a spray nozzle that is adapted for interconnection to both a hose and a cleaning implement.

It is another object and advantage of the present invention to provide a spray nozzle that includes a locking feature that is easily employed by the user to maintain the nozzle in a desired position.

It is yet another object and advantage of the present invention to provide a spray nozzle that includes a trigger that is automatically locked in a predetermined, desired position without any further requirements by the user.

Other objects and advantages of the present invention will in part be obvious, and in part appear hereinafter.

SUMMARY OF THE INVENTION

In accordance with the foregoing objects and advantages, the present invention provides a detachable nozzle used for interconnecting a hose to a cleaning implement or for use as a spray nozzle for a hose. The detachable nozzle extends along a longitudinal axis and includes a downstream end with an internally threaded neck adapted for connection to a hose and an upstream end with an externally threaded neck that is adapted for connection to a cleaning implement or from which water may be discharged. A spring biased actuating trigger engages a lever tied to a spring biased valve and is pivotally movable between its neutral position that places the valve in its closed position, to a fully closed position that places the valve in its fully open position. Thus, when no external force is applied to the actuating trigger, the valve is in its closed position prohibiting the nozzle from discharging water therethrough. When a user squeezes the trigger to its maximum extent, the valve is forcibly opened its maximum amount and releases the greatest unit volume of water through the nozzle. A spring biased trigger lock is actuable by a user to lock the trigger in a predetermined position between its fully closed and neutral positions.

BRIEF DESCRIPTION OF THE DRAWINGS

The present invention will be more fully appreciated and understood by reading the following Detailed Description in conjunction with the accompanying drawings, in which.

DETAILED DESCRIPTION

Figure 1:
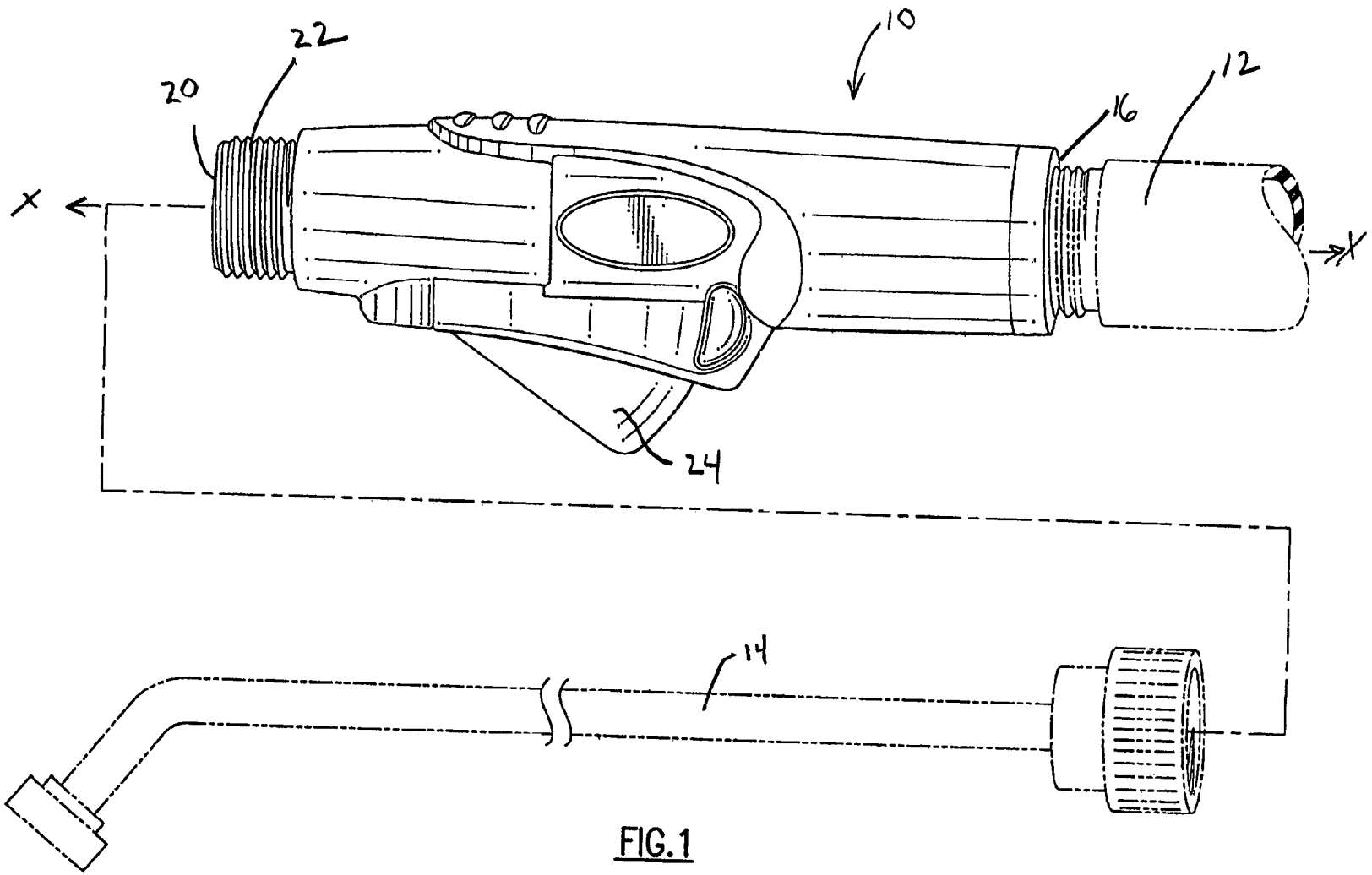
FIG. 1 is an exploded side elevation view of the detachable nozzle present invention interconnected to a hose and a cleaning implement.
Figure 2:
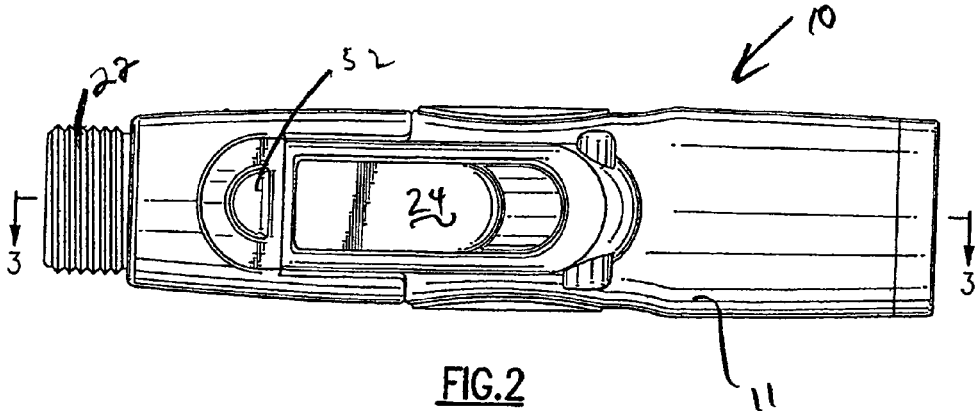
FIG. 2 is a bottom plan view of the detachable nozzle.

Referring now to the drawings, in which like reference numerals refer to like parts throughout, there is seen in FIG. 1 a detachable nozzle, designated generally by reference numeral 10, extending along a longitudinal axis X-X and including a housing 11 that interconnects a hose 12 and a cleaning implement 14. Nozzle 10 includes a upstream end 16 including an internally threaded neck portion 18 that is adapted to threadably receive hose 12 thereon, and a downstream end 20 including an externally threaded neck portion 22 adapted to threadably receive cleaning implement 14 thereon.

Operationally, nozzle 10 generally comprises a user actuated, spring biased trigger 24; a plunger 26 positioned in contacting relation to the inner surface of trigger 24 and concentrically within a spring 28 that provides the bias to trigger 24; a spring biased valve arm 30 that is movable with trigger 24 between fully closed and maximally open positions; a ramped valve lever 32 positioned between plunger 26 and valve arm 30 and providing the force that moves valve arm 30 between its terminal positions; and a spring biased, user actuated trigger lock 34 that cooperates with a toothed rack 36 to fix the position of trigger 24 in a predetermined position between its fully closed and fully open positions. By squeezing trigger 24 from its outermost (neutral) position to its innermost position (relative to housing 11), plunger 26 engages and pushes lever 32, and hence valve arm 30, rearward (towards the upstream end 16) causing compression of the spring 38 that biases valve arm 30. When trigger 24 is in its neutral position, spring 38 biases the head 40 of valve arm 30 into contacting and sealing relation to a gasket 42 preventing water from discharging through downstream end 20 of nozzle 10. The rearward movement of valve arm 30 moves valve head 40 out of engagement with gasket 42, thereby permitting water to be discharged from nozzle 10.

Figure 3A:
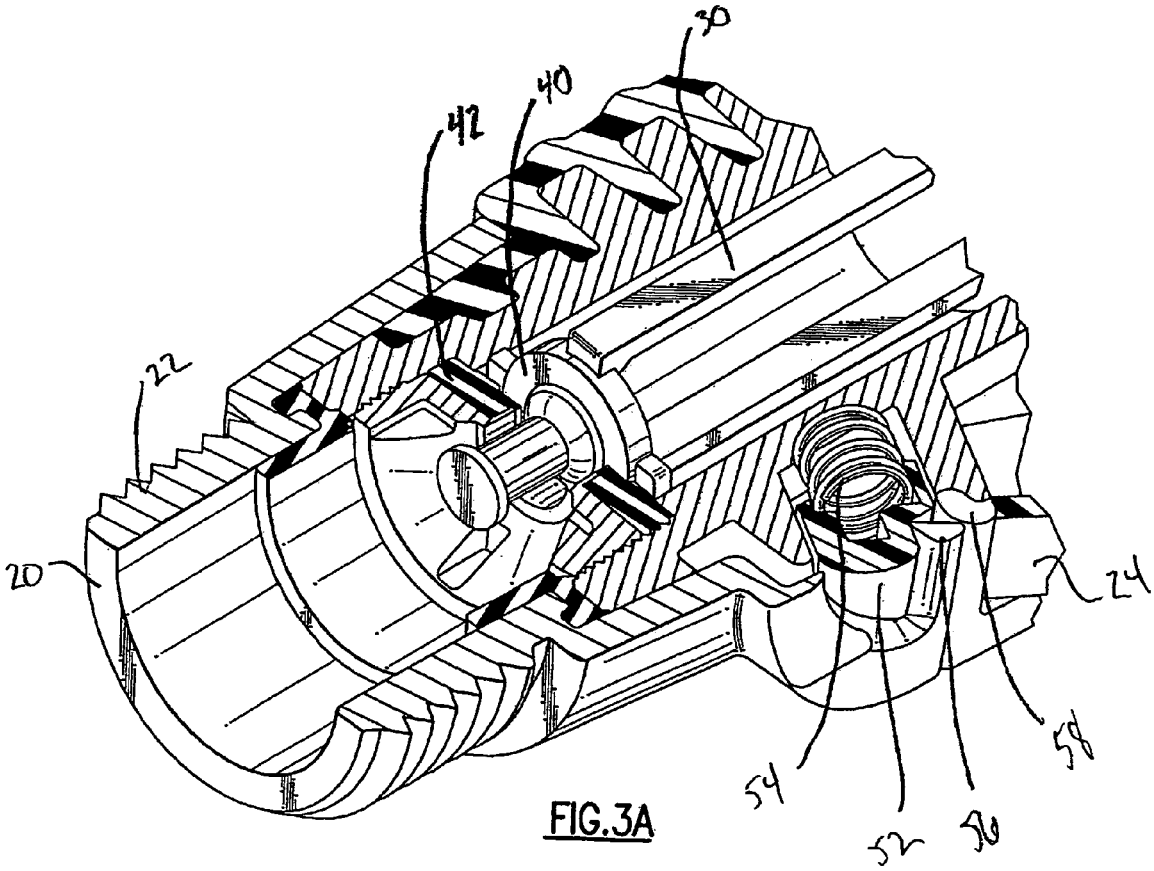
FIG. 3A is an enlarged, partial section view taken at the circled section of FIG. 3.
Figure 3:
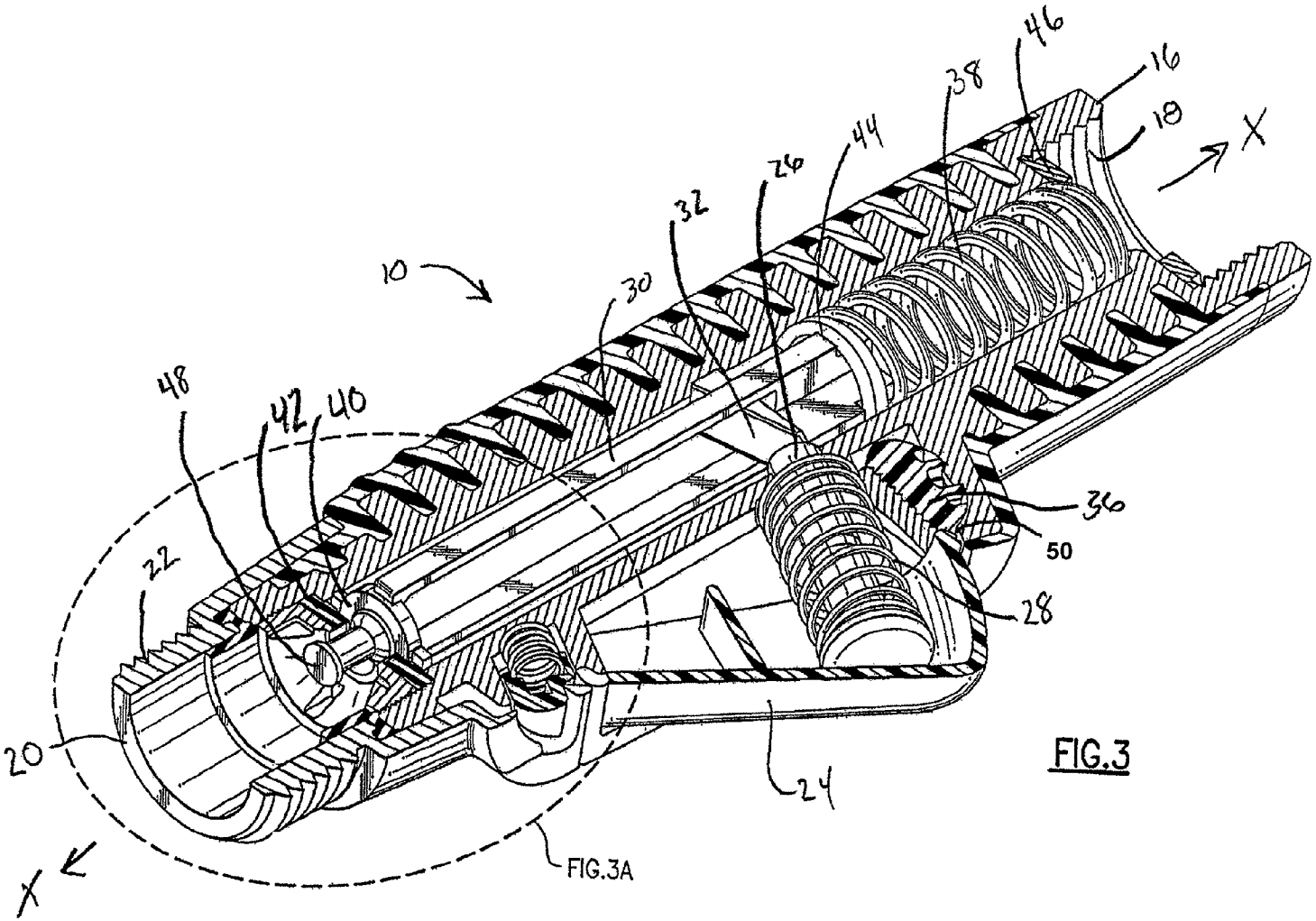
FIG. 3 is a cross-sectional view taken along section line 3-3 of FIG. 2.
Figure 4:
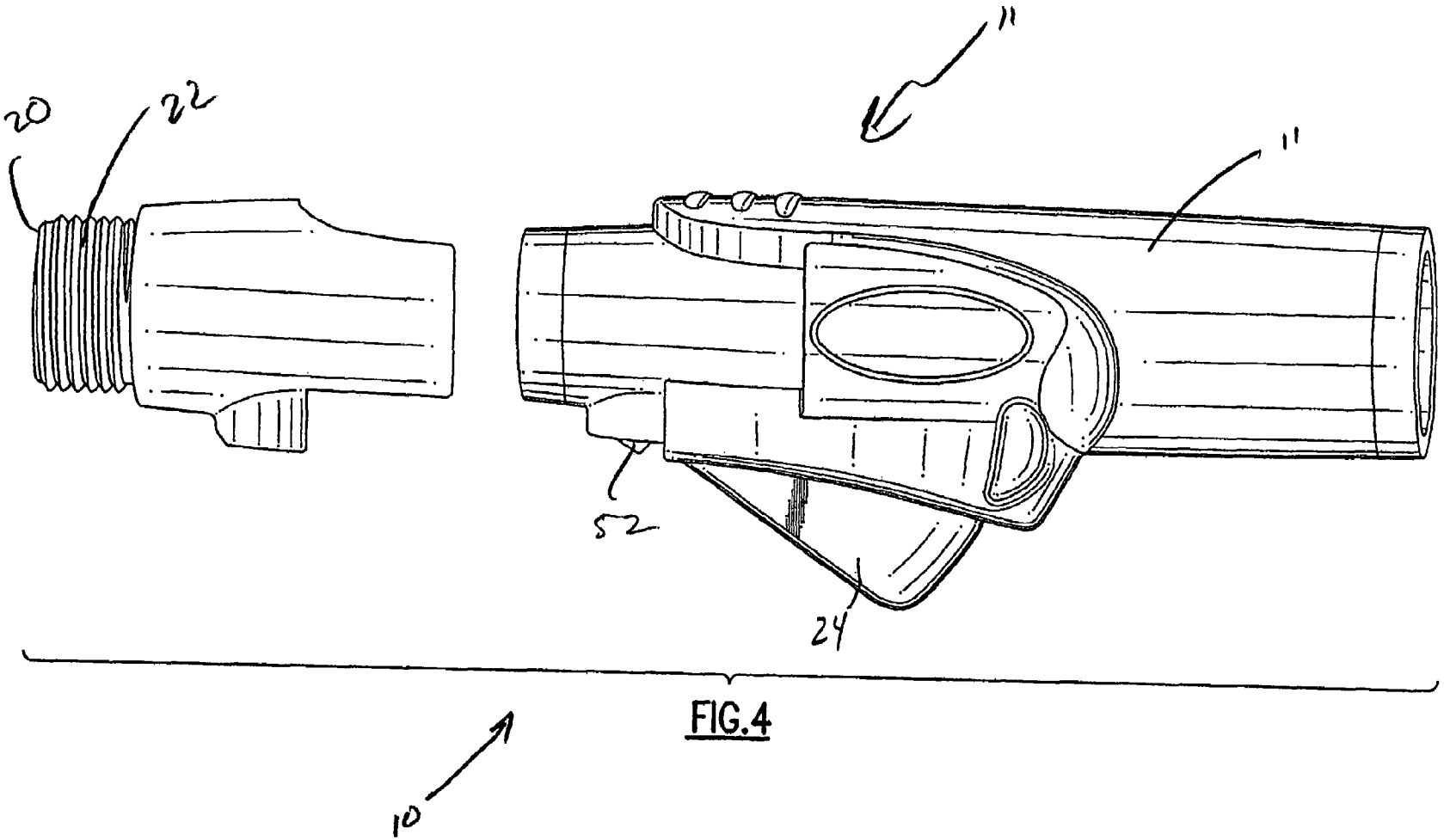
FIG. 4 is a partially exploded side elevation view of the detachable nozzle.

Referring to FIG. 3, valve arm 30 extends co-linearly with axis X-X and includes a shoulder 44 that engages the forward end of spring 38. The rearward end of spring 38 rests on a shoulder 46 formed on the interior of housing 11, adjacent upstream end 16. The forward end of valve arm 30 is securely affixed to or engaged with valve head 40. Thus, movement of valve arm 30 causes simultaneous and corresponding movement of valve head 40. Extending forward from head 40 is a spray diffuser 48 that extends through gasket 42 and causes the water to have a predetermined spray path as dictated by the distance of diffuser 48 from gasket 42. Diffusers, such as diffuser 48, are conventional with spray nozzles.

When trigger 24 is in its neutral position, spring 28 biases it to its maximum outermost position relative to housing 11. When in this position, the end of plunger 26 contacts the lower region of lever 32 which in turn causes spring 38 to bias valve head 40 into sealed relation with gasket 42. thus, when trigger 24 is in its neutral position, water is prohibited from flowing out of nozzle 10.

To spray water from nozzle 10, trigger 24 is squeezed by a user into housing 11. Trigger 24 is pivotally mounted to housing 11 and pivotally moves about axis Y-Y (see FIG. 5.) The outwardly facing surface of the rear wall of trigger 24 include a pair of teeth 50 formed adjacent its upper surface. When trigger 24 is moved inwardly relative to housing 11, teeth 50 engage the teeth on rack 36, locking the trigger in the relative position to the rack 36 when released by the user. The locking of trigger 24 in rack 36 is accomplished by lock 34.

Lock 34 comprises a user actuated button 52 that is biased outwardly by a spring 54. When in its neutral position, button 52 includes a cam surface 56 that cooperates with a corresponding cam surface 58 on trigger 24 that pushes trigger 24 rearwardly, thereby forcing teeth 50 into engaged relation with the teeth on rack 36. To release lock 34 the user actuated button 52 is pressed inwardly by the user. When button 52 is depressed, cam surfaces 56 and 58 become disassociated/disengaged and the bias force of spring 28 moves trigger 24 back to its neutral position.

Figure 5:
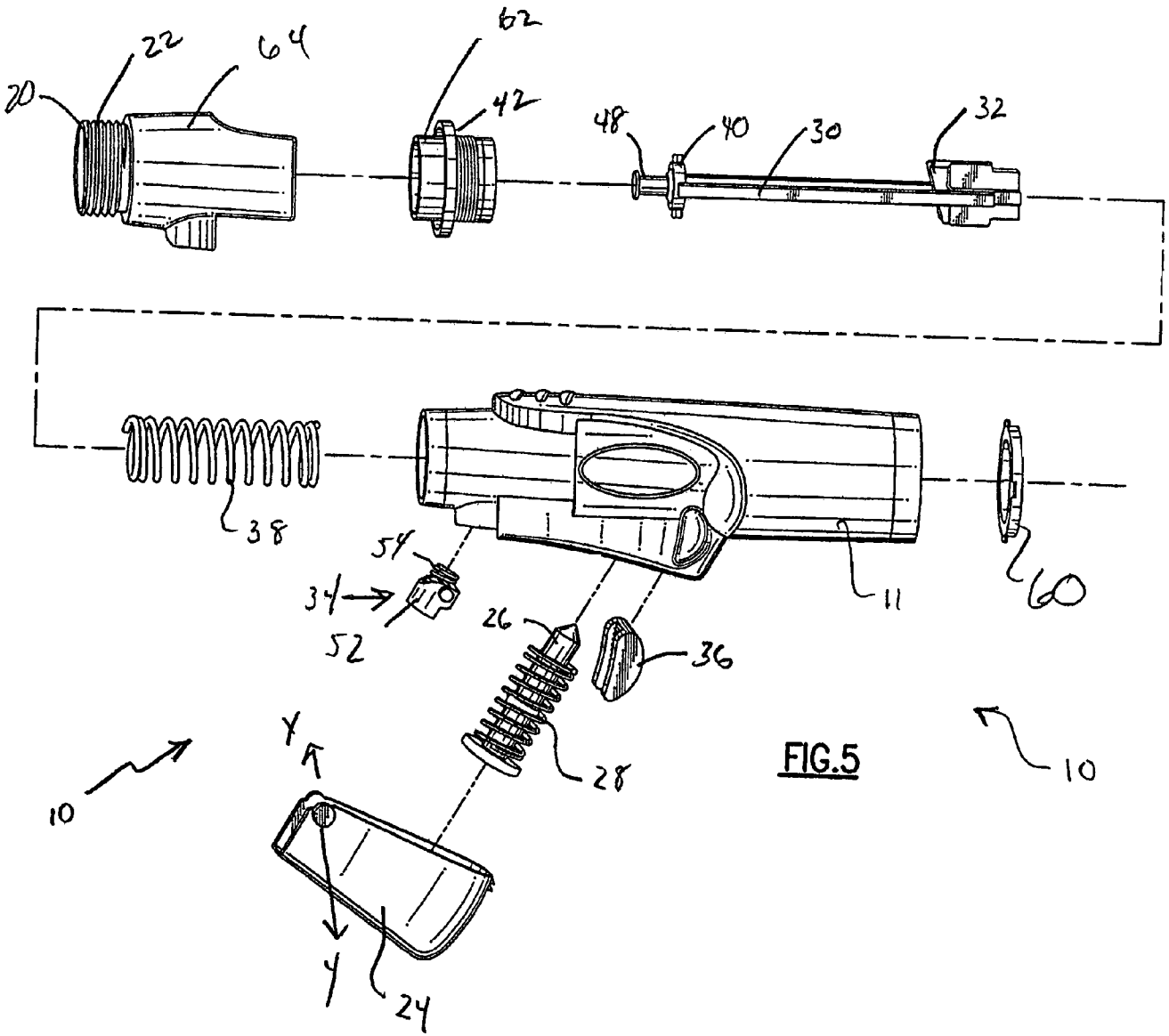
FIG. 5 is a fully exploded side elevation view of the detachable nozzle.

With reference to FIG. 5, nozzle 10 comprises an assemblages of parts, although it could be constructed as an integral molding. Housing 11 provides the cavity in which the operational parts of the nozzle are securely retained, and there is a sealing gasket 60 securely positioned within the upstream end 16 to create a seal between housing 11 and hose 12. a gasket assembly 62, including gasket 42, are threadably connected to the downstream end of housing 11 to seal nozzle head 40, and a discharge assembly 64, including external threads 22 and the ultimate downstream end 20 of the nozzle, is securely attached to the downstream end of housing 11 and gasket assembly 62.

What is claimed is:

1. A nozzle for interconnecting a water supply to a cleaning implement, comprising:

a. a housing that extends along a longitudinal axis and includes first and second ends adapted for interconnection to the water supply and cleaning implement, wherein said housing includes a rack having a first set of teeth, respectively;

b. a valve arm movably positioned within said housing and extending co-linearly along said longitudinal axis; and c. a trigger including a second set of teeth and being cooperatively positioned relative to said housing and adapted for engaging said valve arm and imparting movement thereof along said longitudinal axis, d. a lock associated with said housing to bring said first and second sets of teeth into engagement with each other when said trigger moved from a first trigger position into a second trigger position;

e. a spring interconnected to said housing and said trigger for biasing said trigger into the first trigger position; and a second spring interconnected to said lock;

wherein said valve arm is in a closed position prohibiting the flow of water through said nozzle when said trigger is in the first trigger position, and the valve arm is in an open position allowing the flow of water through said nozzle when said trigger is in the second trigger position.

2. The nozzle of claim 1, further comprising a third spring interconnected to said valve arm and said housing.

3. The nozzle of claim 2, wherein said third spring biases said vale arm into the closed position.

4. The nozzle of claim 3, wherein said valve arm includes a head and housing includes a gasket.

5. The nozzle of claim 4, wherein said head of said valve arm and said gasket of said housing are sealingly engaged when said arm is in said closed position, and out of engagement when said arm is in said open position.

6. The nozzle of claim 5, wherein said lock includes a first cam surface and said trigger includes a second cam that engages said first cam surface when said trigger is moved into the second trigger position.

* * * * *